United States Patent [19]

Allemane

[11] Patent Number: 4,520,898

[45] Date of Patent: Jun. 4, 1985

[54] FOLDING GUARD RAIL FOR A PLATFORM

[76] Inventor: Claude Allemane, 6, rue Chopin, 47000 Agen, France

[21] Appl. No.: 577,485

[22] Filed: Feb. 6, 1984

Related U.S. Application Data

[63] Continuation of Ser. No. 346,030, Feb. 5, 1982.

[30] Foreign Application Priority Data

Feb. 5, 1981 [FR] France ..... 81 02450

[51] Int. Cl.[3] ..... E04G 1/26; E04G 1/34

[52] U.S. Cl. ..... 182/113; 182/223

[58] Field of Search ..... 182/63, 141, 148, 113, 182/222, 223

[56] References Cited

U.S. PATENT DOCUMENTS

| | | | |
|---|---|---|---|
| 665,707 | 1/1901 | Tromanhauser | 182/142 |
| 3,112,010 | 11/1963 | Mihalik | 182/106 |
| 3,664,458 | 5/1972 | Sterns | 182/63 |
| 4,390,080 | 6/1983 | Bushnell | 182/115 |

FOREIGN PATENT DOCUMENTS 941571 4/1956 Fed. Rep. of Germany .

*Primary Examiner*—Reinaldo P. Machado

[57] ABSTRACT

A folding guard rail has two pairs of opposed sides. The rail can occupy two positions; a first position in which the rails extend upwardly from the horizontal surface of a platform surrounded by the rail, and a second position in which the rail is folded over the platform and the sides extend downwardly. A key is provided to immobilize the rail in both of its positions.

12 Claims, 4 Drawing Figures

FOLDING GUARD RAIL FOR A PLATFORM

This is a continuation of application Ser. No. 346,030 filed Feb. 5, 1982.

BACKGROUND OF THE INVENTION

1. Field of the Invention

The present invention relates to a folding guard rail used with either a telescoping or fixed work platform.

2. Discussion of Prior Art

Guard rails are known that are attached to work platforms, such known guard rails being attached to platform frames platform and/or being removable from such frames in order to reduce the height of the work platform once the guard rail is folded in order to enable storage or handling of the frame.

The guard rails that are removable from each side of the frame are fitted within grooves attached to the frame, and include posts with bases which are generally striated in order to prevent involuntary removal of the guard rails from the frame.

These embodiments can be disadvantageous with regard to the placement and storage of the guard rails. Once the guard rails are mounted on the platform, the ends of each side of the guard rails are not joined together, resulting in reduced stability.

An object of the present invention is to overcome the various inconveniences and disadvantages discussed above.

SUMMARY OF THE INVENTION

The present invention is provided for in a first aspect thereof by a folding guard rail for a platform. The folding guard rail comprises two parallel sides positioned exteriorly of the platform, the sides being joined at one end in perpendicular fashion by a third side or railing. The third side includes at least two supporting posts and foot guards. The foot guards are joined at their base to the platform framework. The other ends of the parallel sides are joined by a fourth side which is connected along its upper portion to the outer posts of the parallel sides. In this fashion, the journalled fourth side, positioned perpendicularly to the platform, maintains the guard rail in a normal position. When this fourth side is rotated, the guard rail will pivot and surround the platform frame. Thus, the guard rail, both when in its normal position and when surrounding the platform frame, is bolted to the frame by a key which is inserted into hooks located on the frame of the platform.

BRIEF DESCRIPTION OF THE DRAWINGS

Other characteristics and advantages of the present invention will become more fully apparent from the following description, with respect to the attached drawings, all of which are given as non-limiting examples, wherein.

DETAILED DESCRIPTION OF THE DRAWINGS

Figure 1:
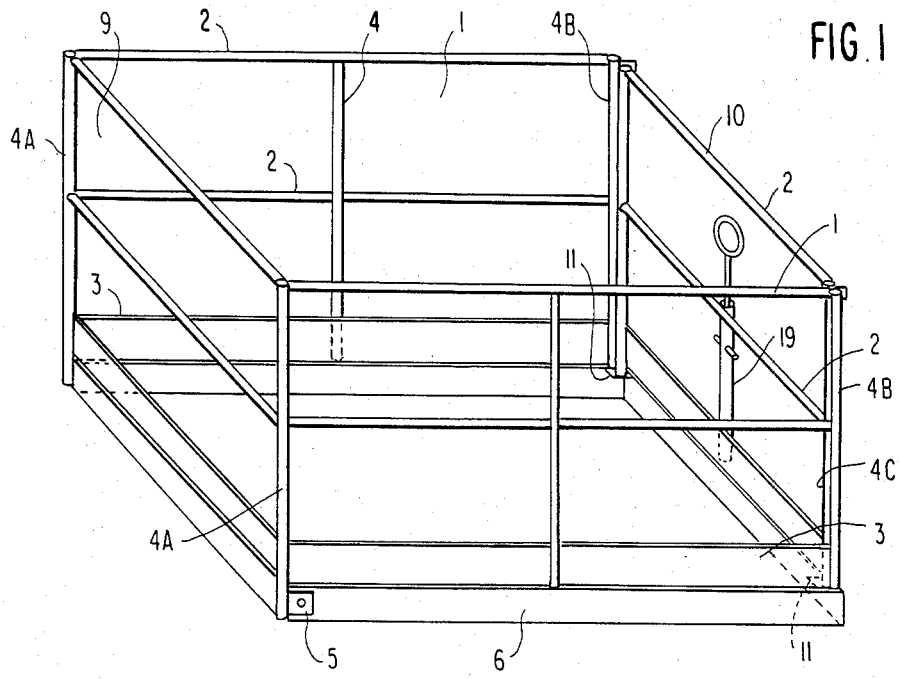
FIG. 1 is an overall perspective view of a platform with a guard rail positioned in a normal position above the platform.
Figure 2:
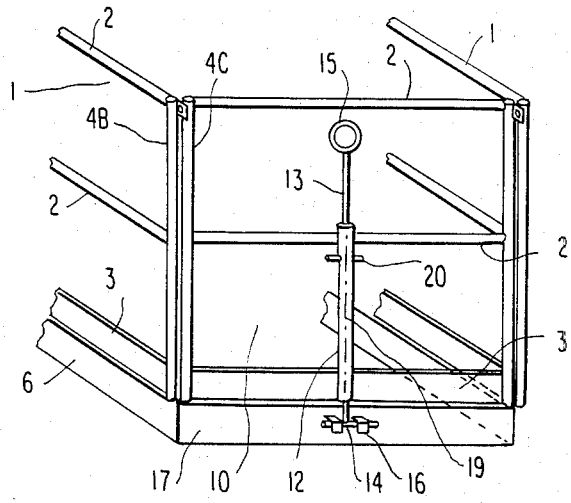
FIG. 2 is a partial perspective view of the fourth, journalled side which maintains the guard rail in its upright position and which is adapted to fold the guard rail about the platform frame when rotated.
Figure 3:
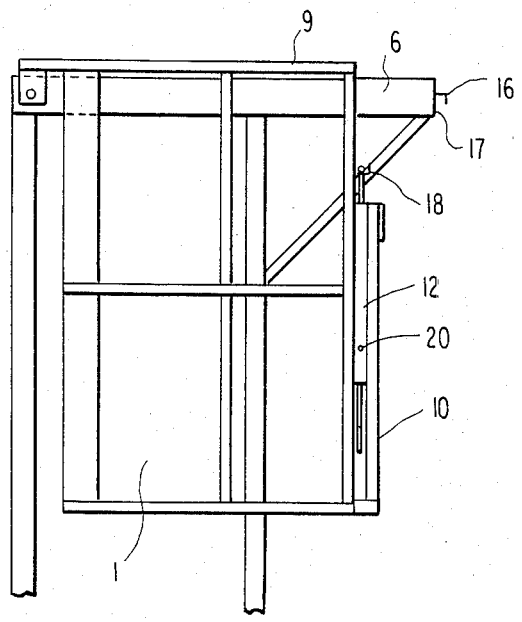
FIG. 3 illustrates the apparatus when the fourth side has been rotated and the guard rail surrounds the platform frame.
Figure 4:
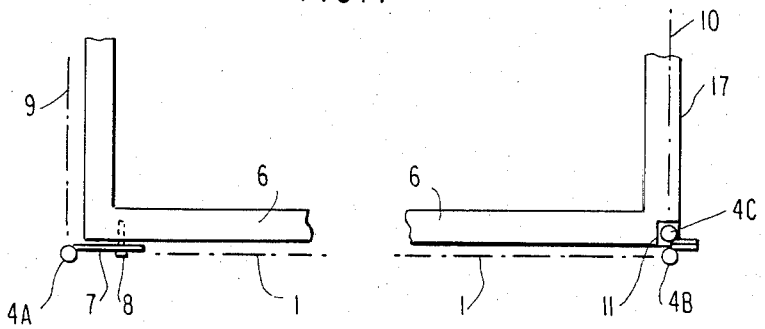
FIG. 4 is a cut-away plan view of the posts of the perpendicular sides which are located on parallel sides of the platform frame.

As illustrated in FIGS. 1 and 2, a folding guard rail attached to the platform in accordance with the present invention includes two parallel sides 1, best shown in FIGS. 1 and 2. Each of the parallel sides comprises one or more tubular or flat iron railings 2 and a lower foot guard 3. Along one end of the parallel sides a third side 9 (see FIG. 1), comprising a pair of rails 2 and a foot guard 3, to attached to the parallel sides. The third side is joined to the two parallel sides by corner posts 4A, the third side also being attached at 5 to a lower portion of the platform frame. This framework is attached to platform 6, e.g., as shown in FIG. 4, by a flat iron 7 and pivotable connection 8. Posts 4A are positioned exteriorly of platform 6 such that parallel sides 1 are also located exteriorly of the platform. At the end of parallel side 1 which is opposite from the end to which side 9 is attached, rails 2 and foot guard 3 are attached by means of corner posts 4B. These corner posts are positioned in a slightly recessed position and are offset from the end of platform 6. Posts 4C, located on the fourth side, maintain rails 2 and foot guards 3 of the fourth side 10 perpendicular to the first and second parallel sides 1. This fourth, journalled side 10 maintains the guard rail in a normal position on platform 6 when the lower portions of posts 4C are positioned within supports 11. Supports 11 are illustrated in FIG. 1, and are positioned on platform 6 to receive posts 4C. When the posts are rotated and thus unclamped from supports 11, the guard rail freely rotates to enclose platform 6 by positioning parallel sides 1 along opposite sides of the platform, as illustrated in FIG. 3. In this position, third side 9 is positioned horizontally on platform 6, fourth side 10 having been folded onto the top rail portion of the first and second sides.

An immobilization key 19 is provided to immobilize the guard rail either in its normal position or in its folded position. The key is illustrated in FIGS. 2 and 3, and incorporates a groove 12 which is integrally connected to fourth side 10. This groove is adapted to receive a sliding shaft 13 provided at one end with a cross bar 14 and at a second end with handle 15. Cross bar 14 is adapted to be inserted into hooks 16 which are attached to outer side 17 of the platform perpendicular to journalled side 10 of the guard rail when the journalled side is positioned to maintain the guard rail in its normal position, or on hooks which are integrally attached to the support frame of the platform when the guard rail surrounds the frame and when journalled side 10 is positioned at 270° with respect to its normal position. In either case, the key immobilizes sides 10 in a desired position. The key is immobilized when cross bar 14 is inserted into either hook 16 or 18 by spindle 20 (see FIGS. 1 and 3).

I claim:

1. A folding guard rail adapted to be placed on a platform having a horizontal surface and a plurality of sides, said guard rail comprising:

(a) two parallel sides, each of said parallel sides having an upper rail and a lower surface and means for rotatably connecting said parallel sides to said platform, said parallel sides adapted to be positioned exteriorly of said platform sides when said guard rail is connected thereto, each of said parallel sides having a first end and a second end;

(b) a third side perpendicularly connected to said first end of each of said parallel sides;

(c) a fourth side perpendicularly journalled to said second end of each of said parallel sides; and (d) means for maintaining said first, second, third and fourth sides of said guard rail in a first position exterior of said platform sides, said maintaining means comprising a key which is integrally connected to said fourth side, said key comprising a sliding shaft having a first end and a second end, said first end of said sliding shaft including a cross bar, said cross bar being adapted to be inserted into hooks located on said platform to render said guard rail immobile, said second end of said sliding shaft having a handle, said maintaining means further comprising a spindle for immobilizing said key when said cross bar is inserted into said hooks, and means for maintaining said guard rail in a second folded position in which said third side is positioned in a horizontal fashion on said horizontal surface of said platform, said first and second parallel sides being positioned exteriorly of and below said platform and said fourth side being journalled in a position which is at an angle of 270° from said second ends of said parallel sides.

2. A folding guard rail adapted to be placed on a platform having a horizontal surface and a plurality of sides, said guard rail comprising:

(a) first and second parallel sides and means for rotatably connecting said parallel sides to said platform, said first and second sides adapted to be positioned exteriorly of said platform sides when said guard rail is connected thereto, each of said parallel sides having a first end and a second end;

(b) a third side perpendicularly connected to said first end of each of said parallel sides; and (c) a fourth side journalled in perpendicular fashion to said second end of each of said parallel sides, said guard rail being adapted to occupy two positions, a first position in which each of said sides extends upwardly from a horizontal surface of said platform and in which said third and fourth sides are parallel to each other and perpendicular to said first and second sides, and a second position in which said first and second sides extend around and downwardly from said horizontal platform surface, said third side being positioned substantially horizontally over said horizontal platform surface and said fourth side being folded so as to abut upper rails of each of said first and second parallel sides.

3. A folding guard rail in accordance with claim 2 further comprising means for maintaining said first, second, third and fourth sides of said guard rail in a position exterior of said platform sides when said guard rail is attached to said platform and in said first position.

4. A folding guard rail in accordance with claim 3 wherein said fourth side comprises at least one vertical post, said vertical post being adapted to be inserted into a support attached to said platform.

5. A folding guard rail in accordance with claim 3 wherein said maintaining means comprises a key which is integrally connected to said fourth side.

6. A folding guard rail in accordance with claim 5 wherein said key comprises a sliding shaft having a first end and a second end, said first end of said sliding shaft having a cross bar, said cross bar being adapted to be inserted into hooks attached to said platform, said second end of said sliding shaft having a handle which is adapted to render said guard rail immobile when said cross bar is inserted within said hooks.

7. A folding guard rail in accordance with claim 6 further comprising a spindle for immobilizing said key when said cross bar is inserted into said hooks.

8. A folding guard rail in accordance with claim 7 wherein said hooks comprise means for maintaining said guard rail in an upright position when all of said sides are in the first position, substantially perpendicular to the horizontal surface of said platform.

9. A folding guard rail in accordance with claim 7 wherein said hooks comprise means for maintaining said guard rail in said folded position when said third side is horizontally positioned on said platform and said fourth side is journalled into a position 270° from said second ends of each of said parallel sides.

10. A folding guard rail in accordance with claim 2 wherein said further comprising means for pivoting said third side of said guard rail onto said platform and into said second, folded position, said pivoting means comprising means for rotatably connecting said third side to said platform.

11. A folding guard rail adapted to be placed on a platform having a horizontal surface and a plurality of sides, said guard rail being stably maintained in at least two positions, said guard rail comprising:

(a) first and second parallel sides and means for rotatably connecting said parallel sides to said platform, said first and second parallel sides being adapted to be positioned exteriorly of said platform sides when said guard rail is connected thereto, each of said first and second parallel sides having a first end and a second end;

(b) a third side perpendicularly connected to said first end of each of said first and second parallel sides; and (c) a fourth side perpendicularly journalled to said second end of each of said parallel sides, said guard rail including means for maintaining said first, second, third and fourth sides in a first position exterior in which all of said four rail sides are positioned exteriorly of said platform sides and in which they extend upwardly from said horizontal surface of said platform, said guard rail further comprising means for pivoting said guard rail onto said platform into a second position in which said third side is horizontally positioned on said horizontal platform surface, and in which said first and second parallel sides are positioned exteriorly of and below said platform and said fourth side is folded into a position 270° from said second end of each of said parallel sides and into a position in which it is in substantial abutment with upper rails of each of said first and second sides.

12. A folding guard rail in accordance with claim 11 further comprising means for maintaining said guard rail in at least two positions, said maintaining means comprising a key which is integrally connected to said fourth side, said key comprising a sliding shaft having two ends, a first end having a cross bar which is adapted to be inserted into hooks attached to said platform, and a second end having a handle, said key further comprising a spindle for immobilizing said key when said cross bar is inserted into said hooks.

* * * * *